US011585153B1

(12) United States Patent
Wingard

(10) Patent No.: US 11,585,153 B1
(45) Date of Patent: Feb. 21, 2023

(54) DEVICE FOR PREVENTION OF LADDER USE

(71) Applicant: Kevin Scott Wingard, Bristol, VA (US)

(72) Inventor: Kevin Scott Wingard, Bristol, VA (US)

( * ) Notice: Subject to any disclaimer, the term of this patent is extended or adjusted under 35 U.S.C. 154(b) by 0 days.

(21) Appl. No.: 17/830,306

(22) Filed: Jun. 1, 2022

(51) Int. Cl.

| | |
|---|---|
| ***E04H 1/12*** | (2006.01) |
| ***E04H 4/06*** | (2006.01) |
| ***E06C 1/08*** | (2006.01) |
| ***E06C 7/00*** | (2006.01) |
| *E06C 1/12* | (2006.01) |
| *E04H 4/14* | (2006.01) |

(52) U.S. Cl.
CPC ..... *E06C 7/006* (2013.01); *E06C 1/08* (2013.01); *E04H 4/06* (2013.01); *E04H 4/144* (2013.01); *E06C 1/12* (2013.01)

(58) Field of Classification Search
CPC ... E06C 7/006; E06C 1/08; E06C 1/12; E06C 1/39; E04H 4/144; E04H 4/06; A63G 21/00
See application file for complete search history.

(56) References Cited

U.S. PATENT DOCUMENTS

| | | | | | |
|---|---|---|---|---|---|
| 3,372,772 | A * | 3/1968 | Singer | E06C 7/006 | 182/230 |
| 4,126,206 | A * | 11/1978 | Becnel | E06C 7/006 | 182/230 |
| 5,421,428 | A * | 6/1995 | Ingles | E06C 7/14 | 182/230 |
| 5,441,126 | A * | 8/1995 | Orrick | E06C 7/006 | 182/230 |
| 6,364,057 | B1 * | 4/2002 | Cornejo | E06C 7/006 | 248/210 |
| 8,505,687 | B2 * | 8/2013 | Allam | E06C 7/006 | 182/230 |
| 10,626,671 | B2 * | 4/2020 | Crowell | G09F 7/18 | |
| 2010/0236865 | A1 * | 9/2010 | Crowton | E06C 1/26 | 182/129 |
| 2016/0153233 | A1 * | 6/2016 | Young | E06C 7/006 | 182/230 |
| 2016/0186493 | A1 | 6/2016 | Young | | |

FOREIGN PATENT DOCUMENTS

| | | | | |
|---|---|---|---|---|
| GB | 2417281 A | | 9/2004 | |
| GB | 2403257 A | * | 12/2004 | E04G 5/10 |
| GB | 2585257 A | | 1/2020 | |
| KR | 102147303 B1 | * | 6/2020 | E04G 5/10 |
| KR | 200495033 Y1 | * | 7/2021 | E04G 5/10 |

OTHER PUBLICATIONS https://treestanddefender.com (screenshots of webpages attached).

* cited by examiner

*Primary Examiner* — Phi D A
(74) *Attorney, Agent, or Firm* — Woods Rogers Vandeventer Black PLC; Nathan A. Evans

(57) ABSTRACT

The invention, according to an embodiment, is a foldable, adjustable, and lockable cover for a plurality of rungs of a ladder. The device renders a ladder prohibitively difficult to climb. In an embodiment, the device is attached to a ladder using a lock, such as a bike lock or padlock, at a top portion of the device, rendering it difficult to for an unauthorized user to climb the ladder to cut any lock holding the device in place and/or remove the ladder.

24 Claims, 14 Drawing Sheets

80

90

DEVICE FOR PREVENTION OF LADDER USE

BACKGROUND OF THE INVENTION

Field of the Invention

The present invention relates to the field of guard devices to prevent unauthorized use of ladders, such as ladders present in or on hunting blinds/tree stands, silos, water towers, radio towers, construction sites, swimming pools, schools, childcare facilities, etc.

Description of Related Art

Many scenarios exist in which it is desirable to prevent unauthorized ladder use, such as in areas where access can result in theft, vandalism, or injury. One example includes preventing use and/or theft of hunting blinds and tree stands. These devices are typically mounted for extended periods of time, such as for the duration of the hunting season, and are left unattended between uses. Another example includes prevention of access to swimming pools. Above-ground pools are frequently fenced and/or require ladders for access. Preventing access to ladders attached to swimming pools could prevent injury or death, such as drowning of unaccompanied/unmonitored children. Further examples include preventing access to areas within construction sites, schools, childcare facilities, hospitals, etc.

A variety of ladder guards exist, such as those disclosed in U.S. Patent Application Publication No. 2016/0186493, U.S. Pat. Nos. 3,968,857, 4,126,206, 5,421,428, 5,441,126, 7,717,231, 7,793,759, and 11,220,864, and foreign patent Nos. GB2417281 and GB2585257. Ladder guard devices often prevent ladder access by shielding several ladder rungs with one or more flat surface(s). The devices also typically comprise a means for affixing the flat surface(s) to the ladder.

Although a variety of ladder guard options exist, a need remains for a device that is easily transported, adjustable in size to fit ladders of different lengths and/or with rungs with different spacing, easy for an intended user to secure and remove, and difficult for an unauthorized user to remove.

SUMMARY OF THE INVENTION

The invention, according to an embodiment, is a foldable, adjustable, and lockable cover for a plurality of rungs of a ladder. The device renders a ladder prohibitively difficult to climb. In an embodiment, the device is attached to a ladder using a lock, such as a bike lock or padlock, at a top portion of the device, rendering it difficult for an unauthorized user to climb the ladder to cut any lock holding the device in place and/or remove the ladder.

Aspects of the invention include Aspect 1, a device comprising: a first panel, comprising a first lip; a second panel, comprising a second lip; one or more hinge; and an adjustable member, comprising: a first end configured to attach to the first panel; and a second end comprising one or more hole(s); wherein the adjustable member is attached to the first panel.

Aspect 2 is the device of Aspect 1, wherein the first lip is disposed along a top edge of the first panel.

Aspect 3 is the device of Aspects 1 or 2, wherein the second lip is disposed along a bottom edge of the second panel.

Aspect 4 is the device of any of Aspects 1-3, wherein the one or more hinge is disposed along a bottom edge of the first panel.

Aspect 5 is the device of any of Aspects 1-4, wherein the one or more hinge connects the first panel to the second panel.

Aspect 6 is the device of any of Aspects 1-5, wherein the first lip comprises a horizontal slit.

Aspect 7 is the device of any of Aspects 1-6, wherein the adjustable member is slidably attached to the first panel.

Aspect 8 is the device of any of Aspects 1-7, wherein the adjustable member is rotatably attached to the first panel.

Aspect 9 is the device of any of Aspects 1-8, wherein the first panel further comprises a vertical slit.

Aspect 10 is the device of any of Aspects 1-9, wherein the first end of the adjustable member is disposed on one face of the first panel, the second end of the adjustable member is disposed on an opposite face of the first panel, and the adjustable member rests in the vertical slit.

Aspect 11 is the device of any of Aspects 1-10, wherein the first and second ends of the adjustable member are disposed on opposite sides of the vertical slit.

Aspect 12 is the device of any of Aspects 1-11, wherein the adjustable member is shaped and sized such that it is permanently attached to the first panel via the vertical slit.

Aspect 13 is the device of any of Aspects 1-12, wherein the second end of the adjustable member configured to pass through the horizontal slit.

Aspect 14 is the device of any of Aspects 1-13, wherein the second end of the adjustable member is sized such that it is capable of passing through the horizontal slit when the adjustable member is slid along the vertical slit.

Aspect 15 is the device of any of Aspects 1-14, further comprising one or more additional panel.

Aspect 16 is the device of any of Aspects 1-15, wherein the one or more additional panel is disposed between the first panel and the second panel.

Aspect 17 is the device of any of Aspects 1-16, wherein the device comprises a first hinge and a second hinge.

Aspect 18 is the device of any of Aspects 1-17, further comprising an additional panel.

Aspect 19 is the device of any of Aspects 1-18, wherein the first hinge connects the first panel to the additional panel and the second hinge connects the additional panel to the second panel.

Aspect 20 is the device of any of Aspects 1-19, wherein the first hinge enables rotation of the first panel relative to the additional panel and the second hinge enables rotation of the second panel relative to the additional panel.

Aspect 21 is the device of any of Aspects 1-20, wherein the first hinge enables rotation of the first panel in a first direction relative to the additional panel and the second hinge enables rotation of the second panel in a second direction relative to the additional panel.

Aspect 22 is the device of any of Aspects 1-21, wherein the first hinge is disposed between the first panel and the one or more additional panel and the second hinge is disposed between the one or more additional panel and the second panel.

Aspect 23 is the device of any of Aspects 1-22, wherein the one or more hole(s) is disposed along the second end of the adjustable member.

Aspect 24 is the device of any of Aspects 1-23, wherein the one or more hole(s) is shaped and sized to accept a padlock and/or bike lock.

Aspect 25 is the device of any of Aspects 1-24, wherein the first lip is configured to rest on a rung of a ladder.

Aspect 26 is the device of any of Aspects 1-25, wherein the second lip is configured to hook around a rung of a ladder.

Aspect 27 is the device of any of Aspects 1-26, wherein the adjustable member, the first panel, and the first lip are configured to enclose a ladder rung.

Aspect 28 is the device of any of Aspects 1-27, wherein the adjustable member is configured to slide in a first direction to allow a ladder rung to pass between the adjustable member and the first lip and to slide in a second direction to pass through the horizontal slit.

Aspect 29 is the device of any of Aspects 1-28, wherein the adjustable member is configured to slide in a first direction to provide a gap between the adjustable member and the first lip and to slide in a second direction to pass through the horizontal slit.

Aspect 30 is the device of any of Aspects 1-29, wherein the adjustable member is configured to slide along the vertical slit.

Aspect 31 is the device of any of Aspects 1-30, wherein the one or more hole(s) is disposed on the adjustable member such that the one or more hole passes through the horizontal slit.

Aspect 32 is the device of any of Aspects 1-31, wherein the device is foldable.

BRIEF DESCRIPTION OF THE DRAWINGS

The accompanying drawings illustrate certain aspects of implementations of the present disclosure, and should not be construed as limiting. Together with the written description the drawings serve to explain certain principles of the disclosure.

DETAILED DESCRIPTION OF VARIOUS EMBODIMENTS OF THE INVENTION

Figure 1:
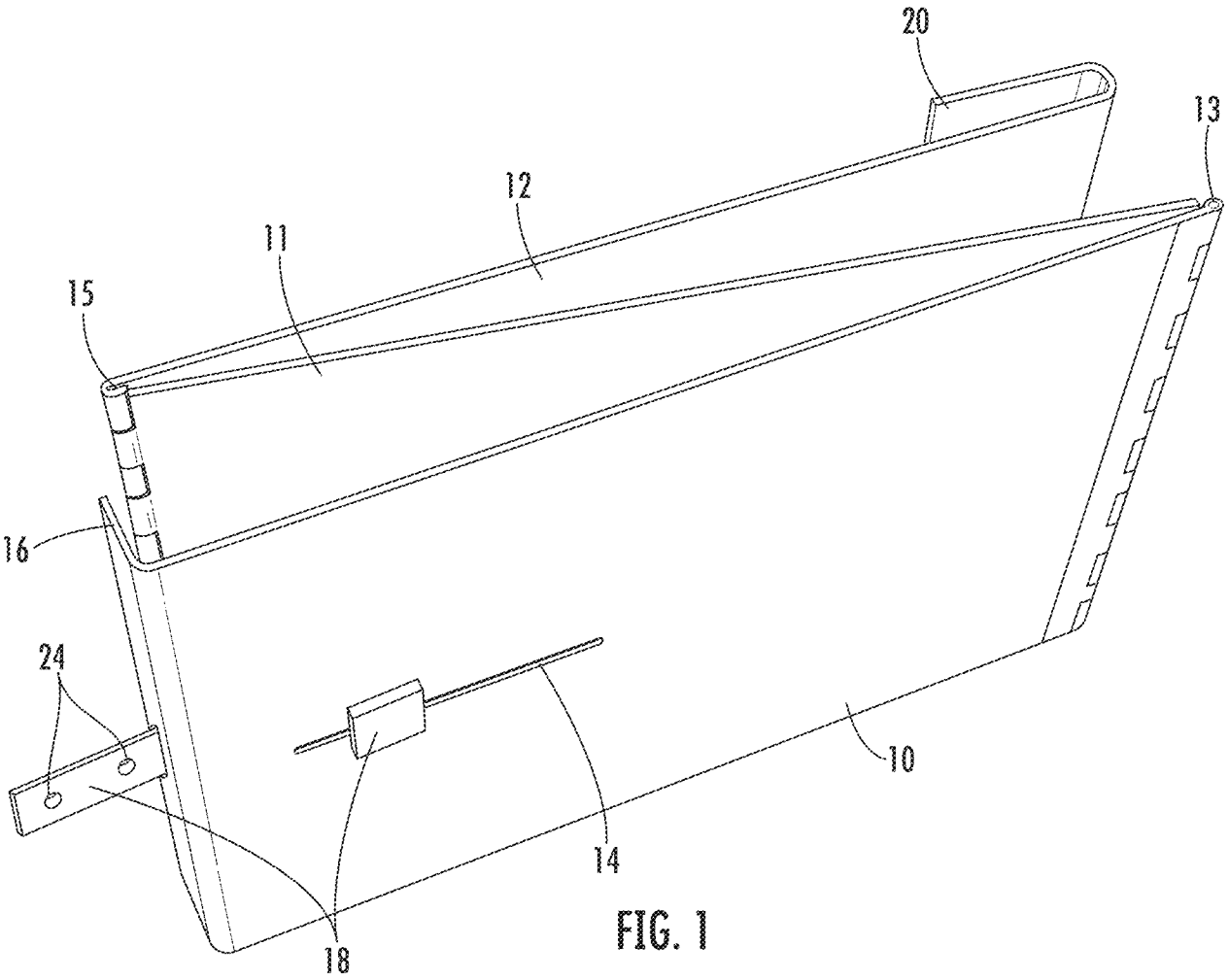
FIG. 1 is a photograph of the folded device according to an embodiment of the invention.

Reference will now be made to various exemplary embodiments of the invention. It is to be understood that the following discussion of exemplary embodiments is not intended as a limitation on the invention. Rather, the following discussion is intended to provide a more detailed understanding of certain aspects and features of the invention.

According to embodiments of the invention, the device comprises one or more panel(s), lip(s), hinge(s), and/or adjustable member(s), comprising one or more hole(s).

In embodiments, the device comprises a panel with a first lip and a second lip, wherein the lips are disposed along opposite ends of the panel. In other embodiments, the device comprises a first panel and a second panel, wherein first and second panels each comprise a lip disposed along one the edge of each panel. The first lip may be disposed along the top of the first panel and the second lip may disposed along a bottom edge of the second panel.

In embodiments, the device comprises a plurality of panels, such as 2, 3, 4, 5, or more panels. In embodiments, the panels are rotatably connected by one or more hinge(s). For example, a first hinge enables rotation of a first panel relative to a second panel and a second hinge enables rotation of a third panel relative to the second panel. In an embodiment of the invention, a first hinge enables rotation of a first panel in a first direction relative to a second panel and a second hinge enables rotation of a third panel in a second direction relative to second panel. In embodiments, the device comprises panels and hinges arranged such that the device is capable of folding.

In an embodiment of the invention, the panels are approximately the same length. In other embodiments, one or more panel(s) is shorter or longer than the other panel(s).

In embodiments, the lip is configured to rest on a rung of a ladder and/or to hook over or under a rung of a ladder. The lip may extend along the entire edge of the panel or may extend only partially along the length of the panel edge. In some embodiments, the lip may comprise one or more gap such that the edge of the panel has one or more area with a lip and one or more area without a lip.

In embodiments, the lip comprises a first surface which contacts the panel approximately perpendicularly, such that the panel and the lip form an "L" shape. In other embodiments, the lip additionally comprises a second surface which contacts the first surface perpendicularly, such that the second surface is parallel to the panel. In some embodiments, the lip is rounded, such that the lip and the panel form a "U" shape where the lip and the panel meet.

In an embodiment of the invention, the device comprises an adjustable member. The adjustable member comprises a first end configured to attach to a panel. In embodiments, the adjustable member is reversibly attached to the panel. In other embodiments the adjustable member is permanently attached to the panel. The adjustable member may be rotatably attached to the panel (for example, via a hinge) and/or slidably attached to the panel (for example, via a sliding mechanism or track attached to the panel).

In embodiments, the adjustable member is slidably attached to the panel via a vertical slit or aperture in the panel. The vertical slit or aperture is sized such that the adjustable member is able to slide vertically along a portion of the panel, but cannot be removed from the panel. For example, in an embodiment of the invention, the device is assembled such that both ends of the adjustable member are shaped and/or sized such that they cannot fit through the vertical slit. In embodiments, a first end of the adjustable member is disposed on one face of the panel, a second end of the adjustable member is disposed on an opposite face of the panel, and the adjustable member rests in the vertical slit or aperture. In embodiments, the vertical slit or aperture is uniform in width along its length. In other embodiments, the vertical slit or aperture is wider at one or more location along its length than it is at another location.

In an embodiment of the invention, the lip comprises a horizontal slit or aperture capable of receiving the adjustable member.

In an embodiment of the invention, a hinge is disposed along an edge of a panel to connect it to another panel. In embodiments, the hinge is disposed along an edge of the panel opposite the lip. In embodiments, the hinge is disposed along the bottom edge of the first panel and the top edge of the second panel, such that the device comprises two panels rotatably connected by the hinge, with a first lip disposed across the top of the first panel and a second lip disposed across the bottom of the second panel.

In embodiments, the adjustable member comprises a first end configured to attach to a panel and a second end configured to accept one or more locking mechanism. For example, the second end of the adjustable member comprises one or more hole(s) disposed along its length. In embodiments, the one or more hole(s) is shaped and sized to accept a padlock and/or bike lock. In embodiments, the second end of the adjustable member is configured to pass through the horizontal slit or aperture, such that one or more hole(s) disposed along the adjustable member extend above the lip. In embodiments, a lock can be attached through the one or more hole(s) when the one or more hole(s) is extended above the panel lip.

In embodiments of the invention, the adjustable member, a panel, and a lip are configured to enclose a ladder rung when the device is installed on a ladder. For example, the adjustable member is configured to slide in a first direction to create a gap between the adjustable member and the lip to allow a ladder rung to pass between the adjustable member and the lip. A user places the lip over the ladder rung, and the adjustable member is then slid in a second direction to pass through the horizontal slit, where a lock is placed through one or more of the holes of the adjustable member. In an embodiment of the invention, the device is attached to a ladder at an upper rung and at a lower rung using the combination of an adjustable member, panel, lip, and lock.

In an embodiment of the invention, the adjustable member comprises a single hole. In other embodiments, the adjustable member comprises a plurality of holes, such as 2, 3, 4, 5, or more holes.

In an embodiment of the invention, the device may comprise one or more of hook(s), clasp(s), strap(s), buckle(s), fastener(s), cutout(s), etc. that may be used to secure one or more panels of the device in a folded position to prevent the device from unfolding during transport.

In embodiments, the device comprises one or more hand hold(s), such as cutout(s) in one or more of the panels, or handle(s) for ease of carrying. In embodiments, the device comprises one or more straps configured for securing the folded device to a user, such that the user may transport the folded device in a hands-free manner. For example, the device may comprise a cross body strap or one or more shoulder strap(s) so that in aspects it can be transported like a backpack.

Example 1

A device, according to an embodiment of the invention, is shown in FIGS. 1-5. FIG. 1 shows said device in a folded configuration. The device comprises at least a first panel 10 and a second panel 12. The first panel 10 comprises a first slit 14 and a top lip 16 which are configured to accommodate an adjustable locking mechanism 18. The second panel comprises a bottom lip 20. In embodiments, the device comprises one or more additional panel(s) 11. In an embodiment of the invention, the first panel 10 is connected to an additional panel 11 by a first hinge 13, and the second panel 12 is connected to the additional panel 11 by a second hinge 15.

Figure 2:
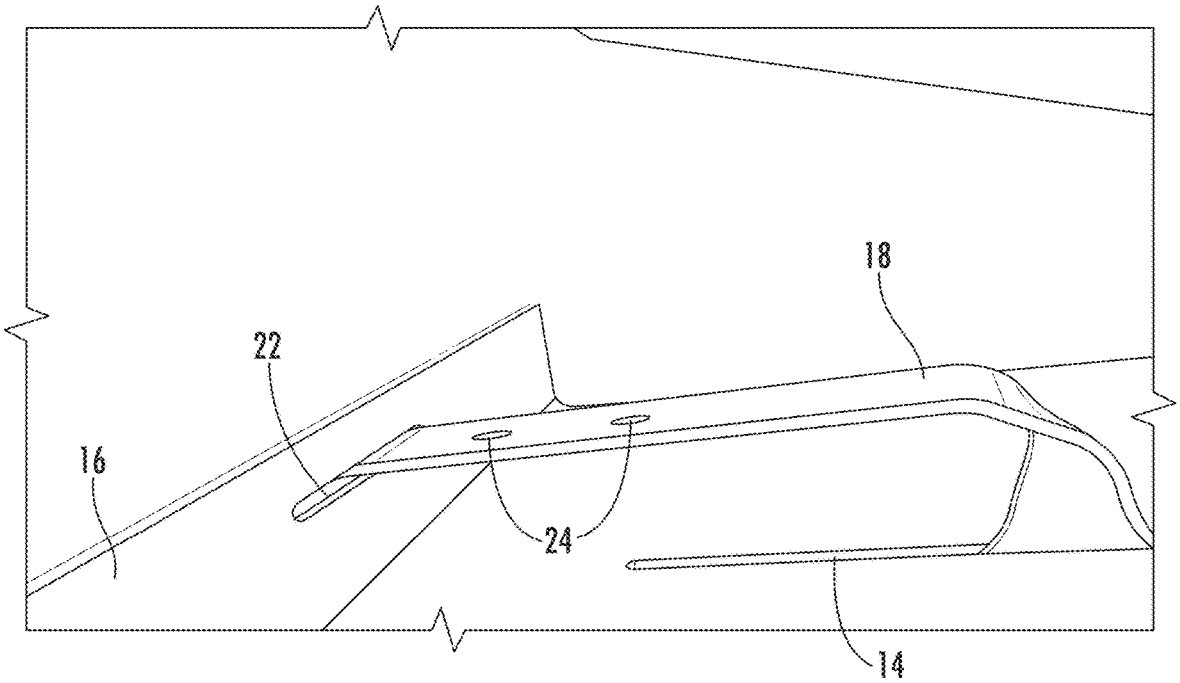
FIG. 2 is a photograph of an adjustable member installed on a panel according to an embodiment of the invention.

FIG. 2 is a zoomed in view of the back of the first panel 10, according to an embodiment of the invention. The top lip 16 comprises a second slit 22. The adjustable locking mechanism 18 is configured to slide along the first slit 14 and pass through the second slit 22. The adjustable locking mechanism 18 further comprises one or more hole(s) 24 configured to accept a lock (not shown). In order to hold the adjustable locking mechanism 18 in a desired position, a lock may be placed through the one or more hole(s) 24 after sliding the adjustable locking mechanism 18 such that one or more of the hole(s) 24 are located above the top lip 16.

Figure 3:
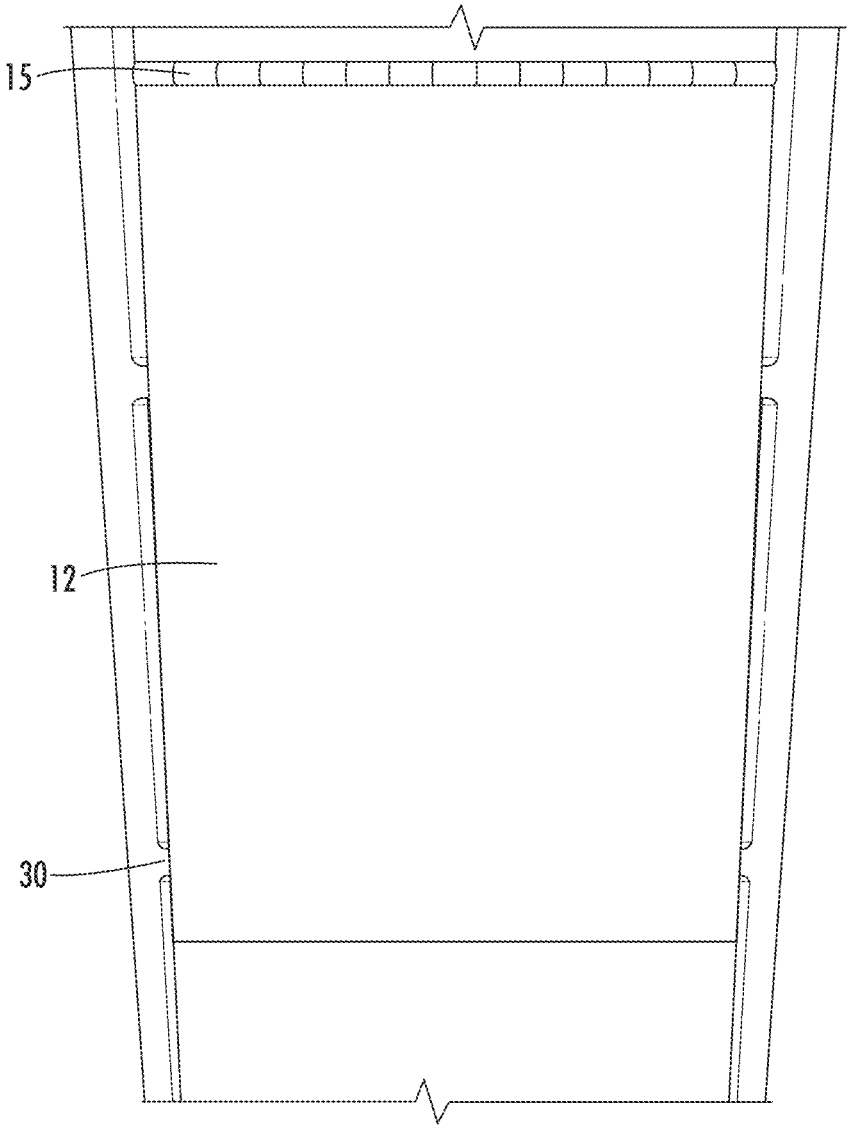
FIG. 3 is a photograph of a panel installed on a ladder according to an embodiment of the invention.
Figure 4:
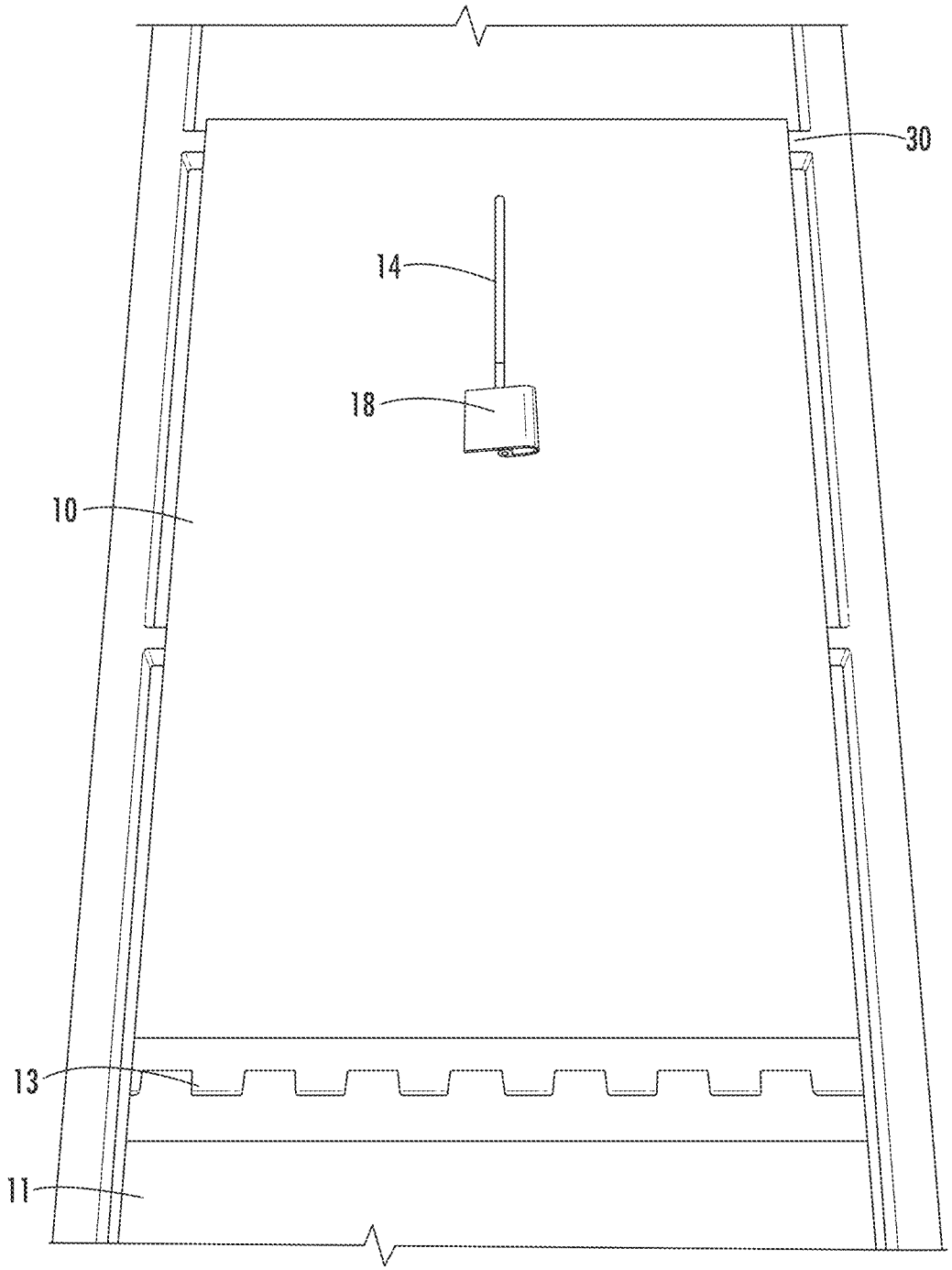
FIG. 4 is a photograph of a panel installed on a ladder according to an embodiment of the invention.
Figure 5:
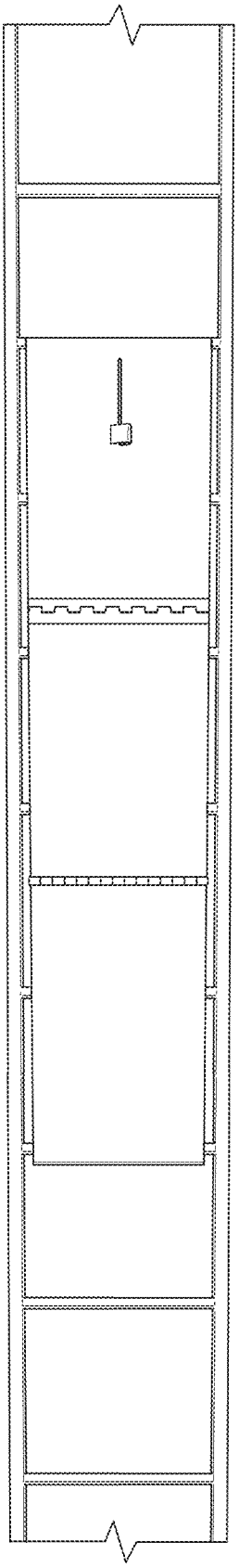
FIG. 5 is a photograph of the device installed on a ladder according to an embodiment of the invention.

FIGS. 3-5 show the device installed on a ladder, according to an embodiment of the invention. FIG. 3 shows the second panel 12. The bottom lip 20 (not visible in the front view of the device) hooks under a ladder rung 30. FIG. 4 shows the first panel 10, wherein the top lip 16 (not visible in the front view of the device) is installed over a rung 30 of a ladder. The adjustable locking mechanism 18 is not secured in FIGS. 3-5. When not secured by a lock, the adjustable locking mechanism 18 rests in the first slit 14.

FIG. 5 shows the device, according to an embodiment of the invention, installed on a ladder.

Example 2

FIGS. 6A-11E are drawings detailing certain aspects of certain embodiments of the invention.

Figure 6A:
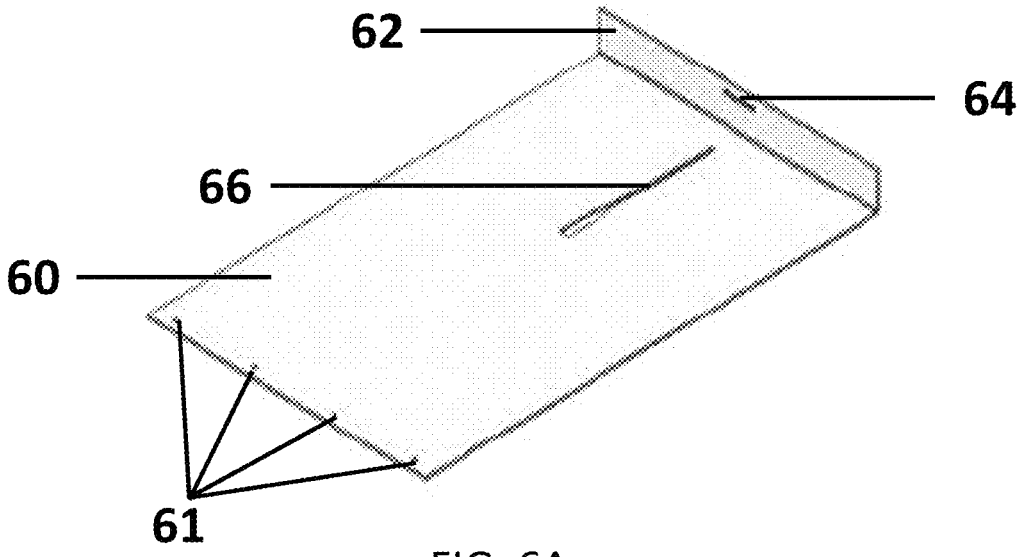
FIGS. 6A-E are drawings of a panel according to an embodiment of the invention, including a perspective view (FIG. 6A), a top view (FIG. 6B), a detail view (FIG. 6C), a front view (FIG. 6D), and a side view (FIG. 6E).
Figure 6B:
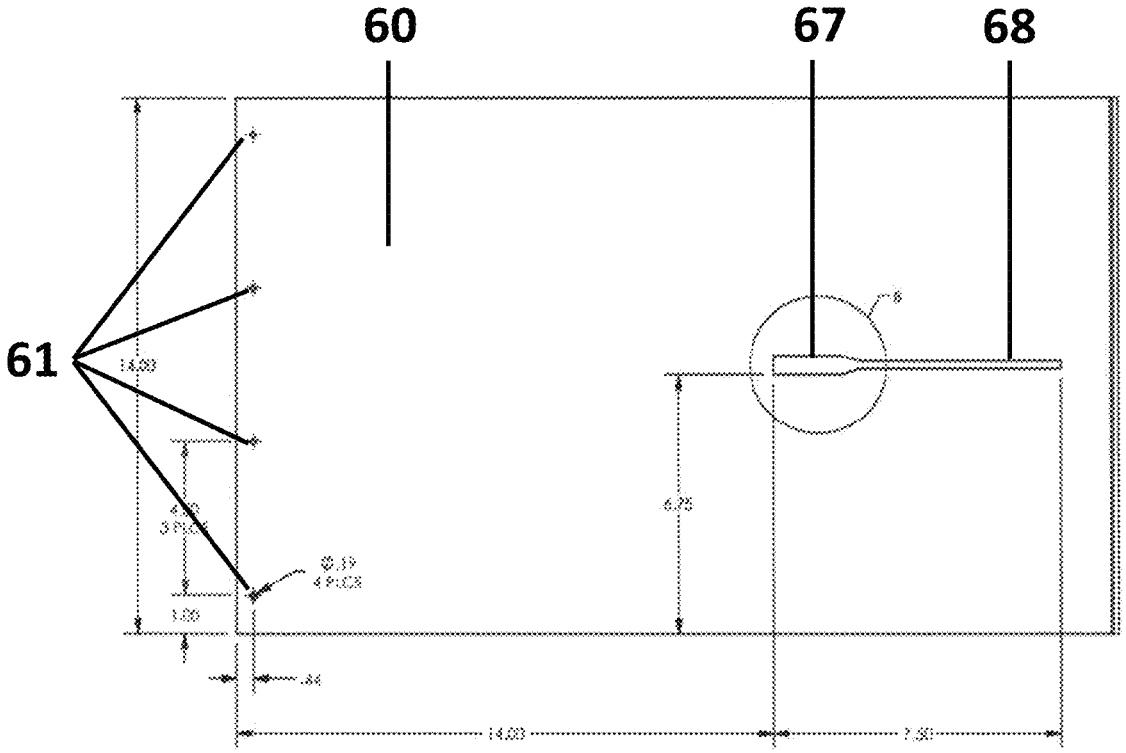
Figure 6C:
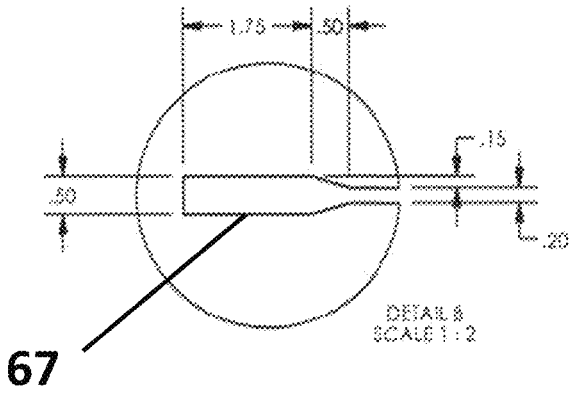
Figure 6D:
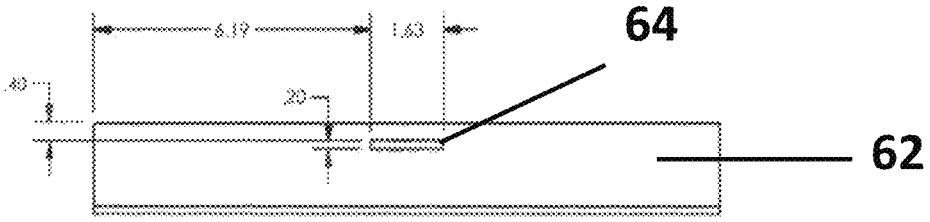
Figure 6E:
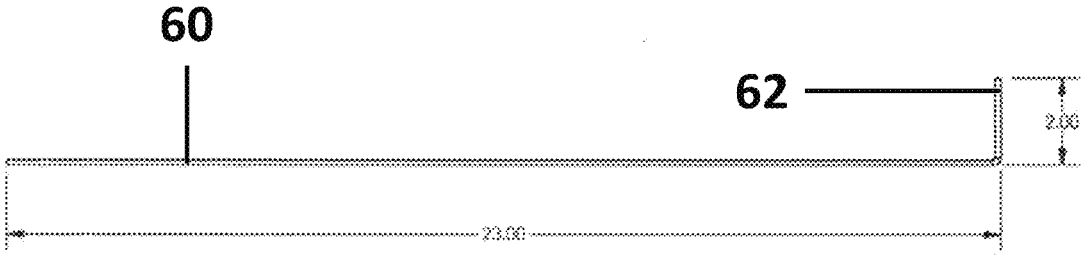

FIGS. 6A-E show aspects of a first panel 60, according to embodiments of the invention. The first panel 60 further comprises a first lip 62. The first panel 60 comprises one or more locations 61 for attachment of a hinge. In embodiments, the first lip further comprises a horizontal slit 64 and a vertical slit 66. The vertical slit 66 is wider at a first end 67 than at a second end 68 (FIGS. 6B-C).

Figure 7A:
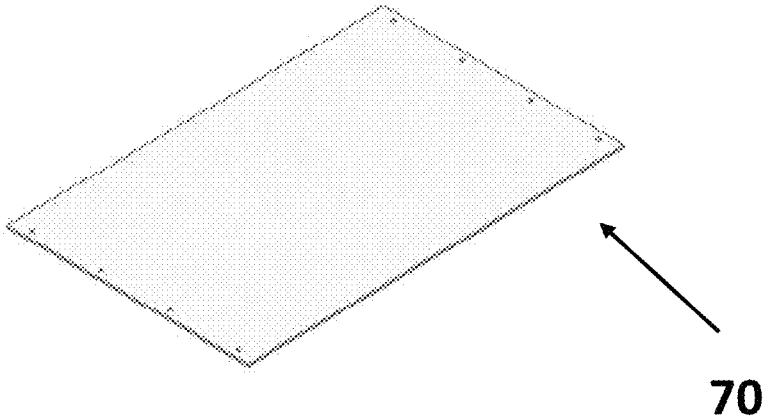
FIGS. 7A-B are drawings of a panel according to an embodiment of the invention, including a perspective view (FIG. 7A) and a top view (FIG. 7B).
Figure 7B:
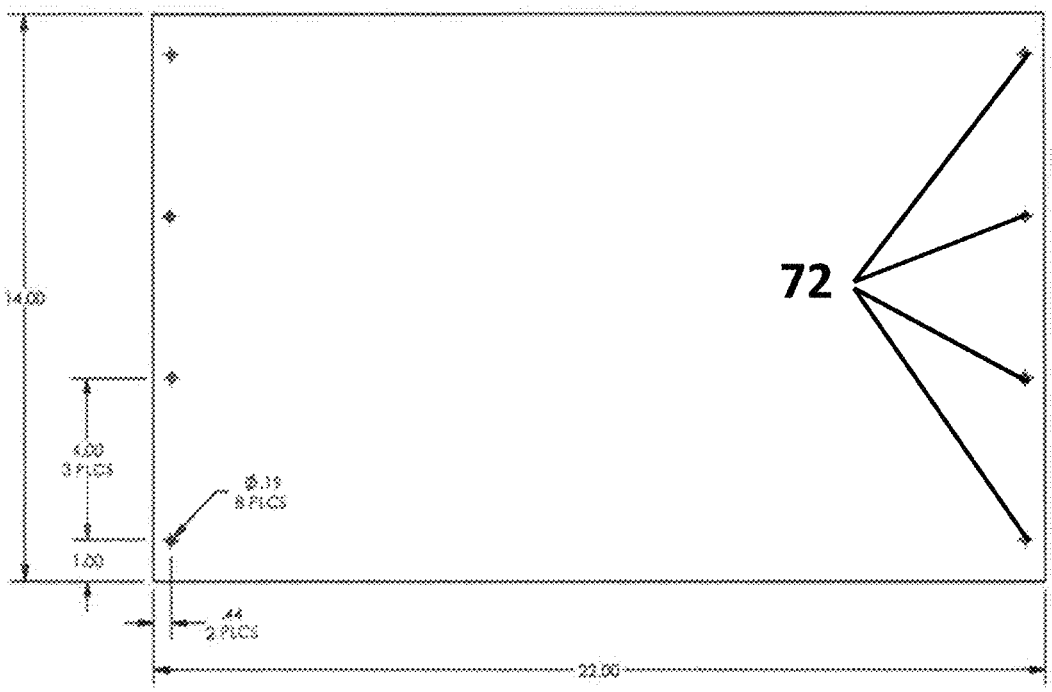

FIGS. 7A-B show optional additional panels 70 that can be added to extend the length of the device according to an embodiment of the invention. In embodiments, the additional panel(s) 70 comprise locations 72 for attachment of a hinge on each end.

Figure 8A:
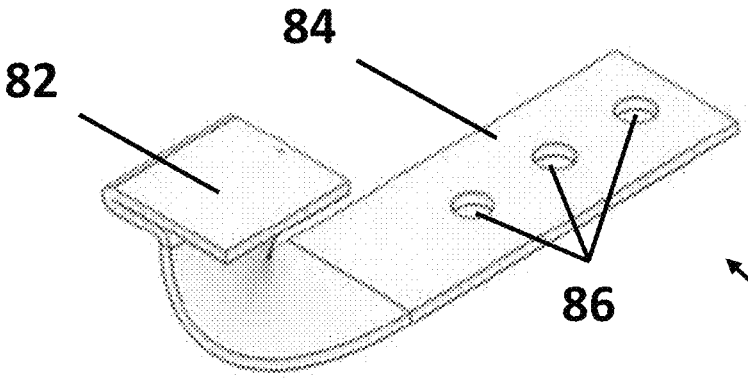
FIGS. 8A-B are drawings of an adjustable member according to an embodiment of the invention, including a perspective view (FIG. 8A) and a top view (FIG. 8B).
Figure 8B:
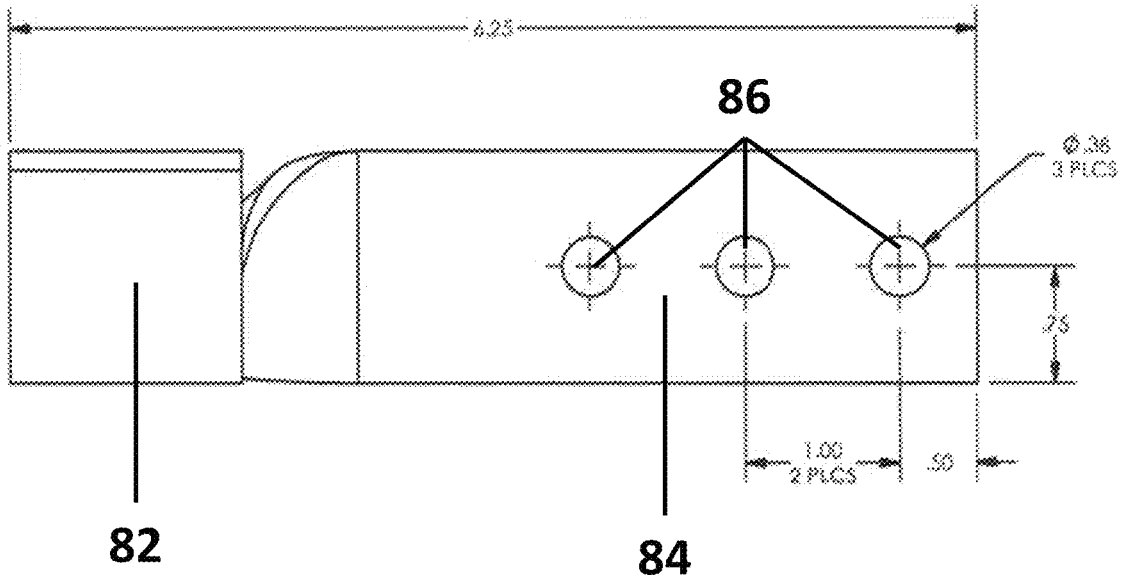
Figure 8C:
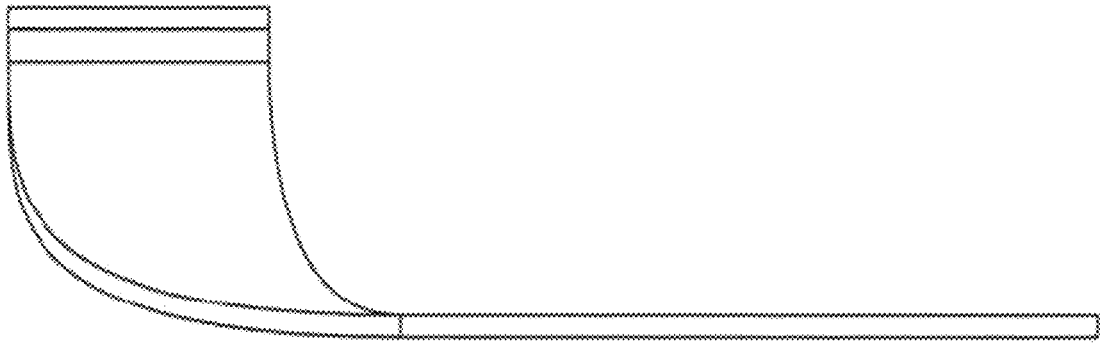
FIG. 8C is a drawing of an adjustable member prior to shaping, according to an embodiment of the invention.
Figure 8D:
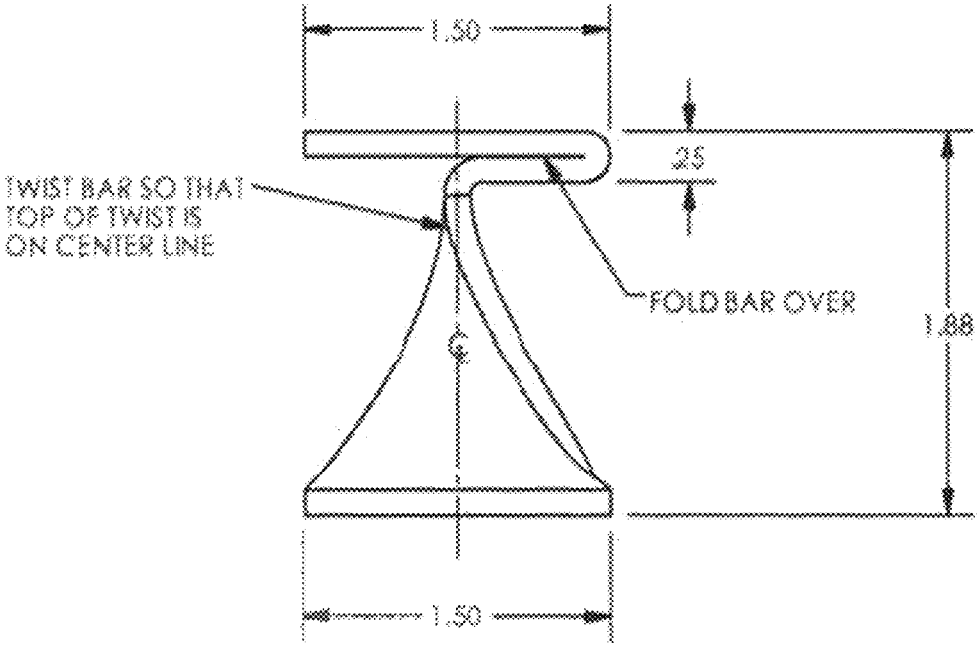
FIG. 8D is a drawing of a front view of an adjustable member according to an embodiment of the invention.

FIGS. 8A-B show an example embodiment of adjustable member 80 according to an embodiment of the invention. Adjustable member 80 comprises a first end 82 and a second end 84. The second end 84 comprises holes 86 configured to accept a padlock or bike lock. FIGS. 8C-D show the adjustable member before (FIG. 8C) and after (FIG. 8D) it is shaped to provide the first end and the second end as shown in FIG. 8A.

Figure 9A:
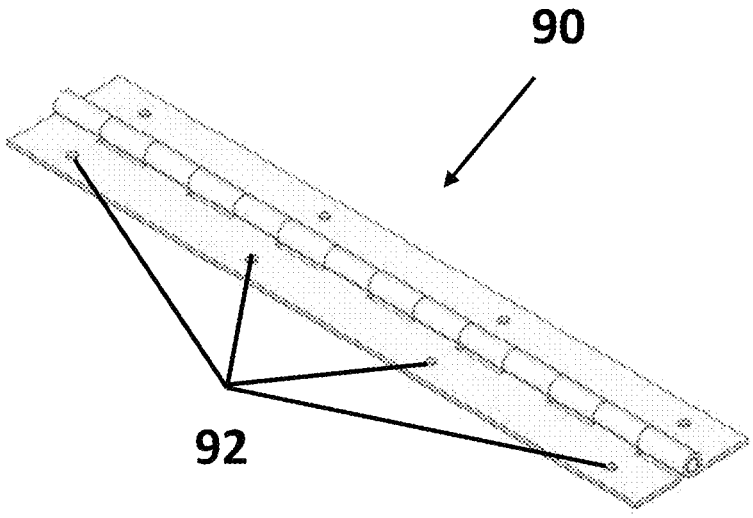
FIGS. 9A-C are drawings of a hinge according to an embodiment of the invention, including a perspective view (FIG. 9A), a side view (FIG. 9B), and a top view (FIG. 9C).
Figure 9B:
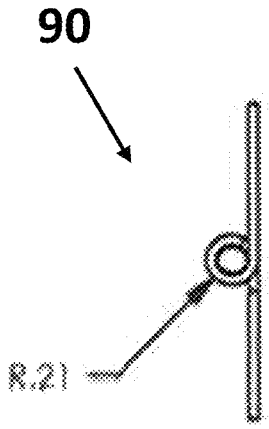
Figure 9C:
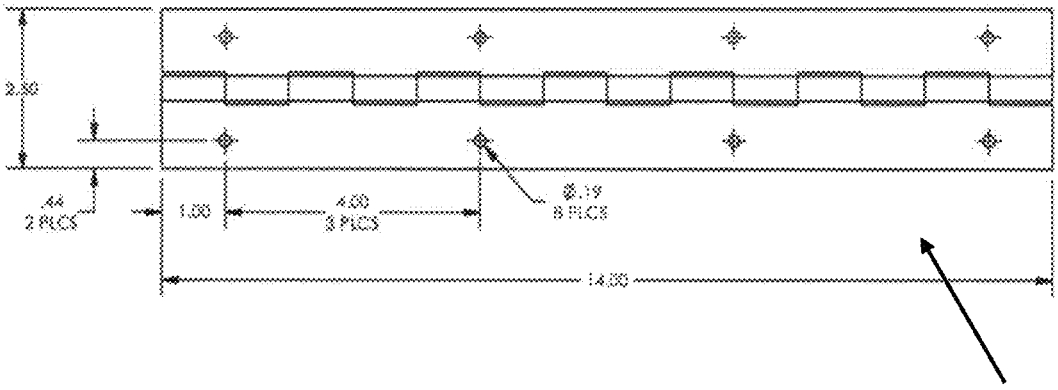

FIGS. 9A-C show an example embodiment of a hinge 90 according to an embodiment of the invention. The hinge 90 comprises several locations 92 for attaching the hinge to the panels. FIG. 9A is a perspective view, FIG. 9B is a side view, and FIG. 9C is a top view of hinge 90.

Figure 10A:
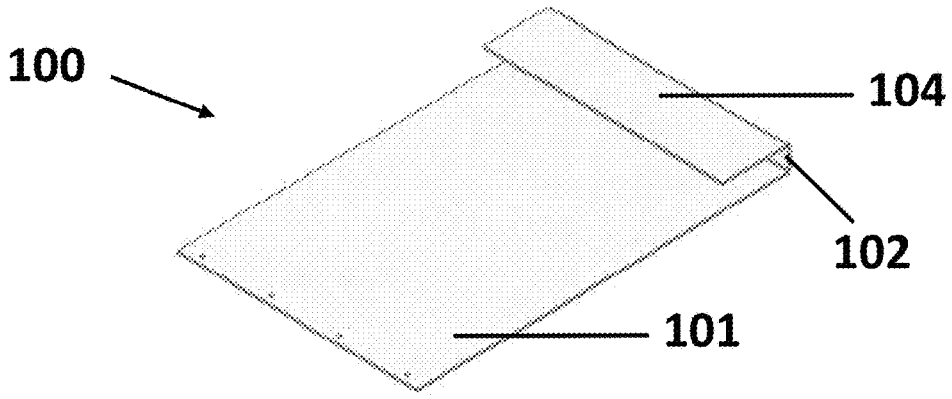
FIGS. 10A-C are drawings of a panel according to an embodiment of the invention including a perspective view (FIG. 10A), a top view (FIG. 10B), and a side view (FIG. 10C).
Figure 10B:
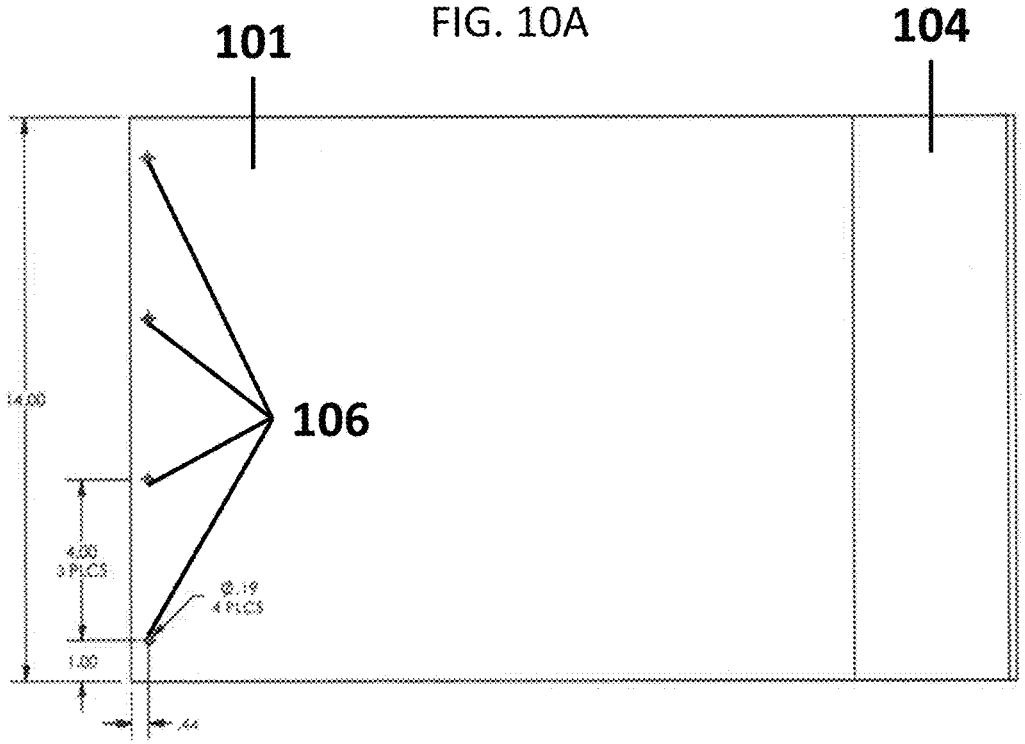
Figure 10C:
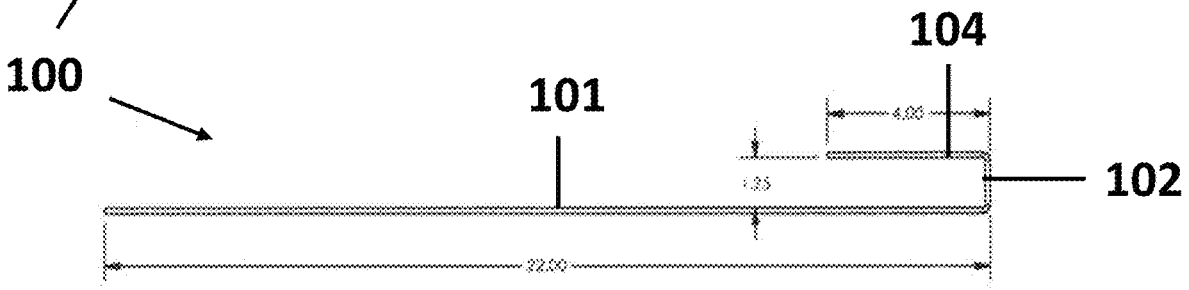

FIGS. 10A-C show an example embodiment of a second panel 100 according to an embodiment of the invention. The second panel 100 comprises a lip. The lip comprises a first surface 102 which is disposed against the panel body 101 at approximately a 90-degree angle, and a second surface 104 which is disposed against the first surface 102 at approximately a 90-degree angle. The second panel 100 further comprises several locations 106 for attaching a hinge.

Figures 11A, 11B:
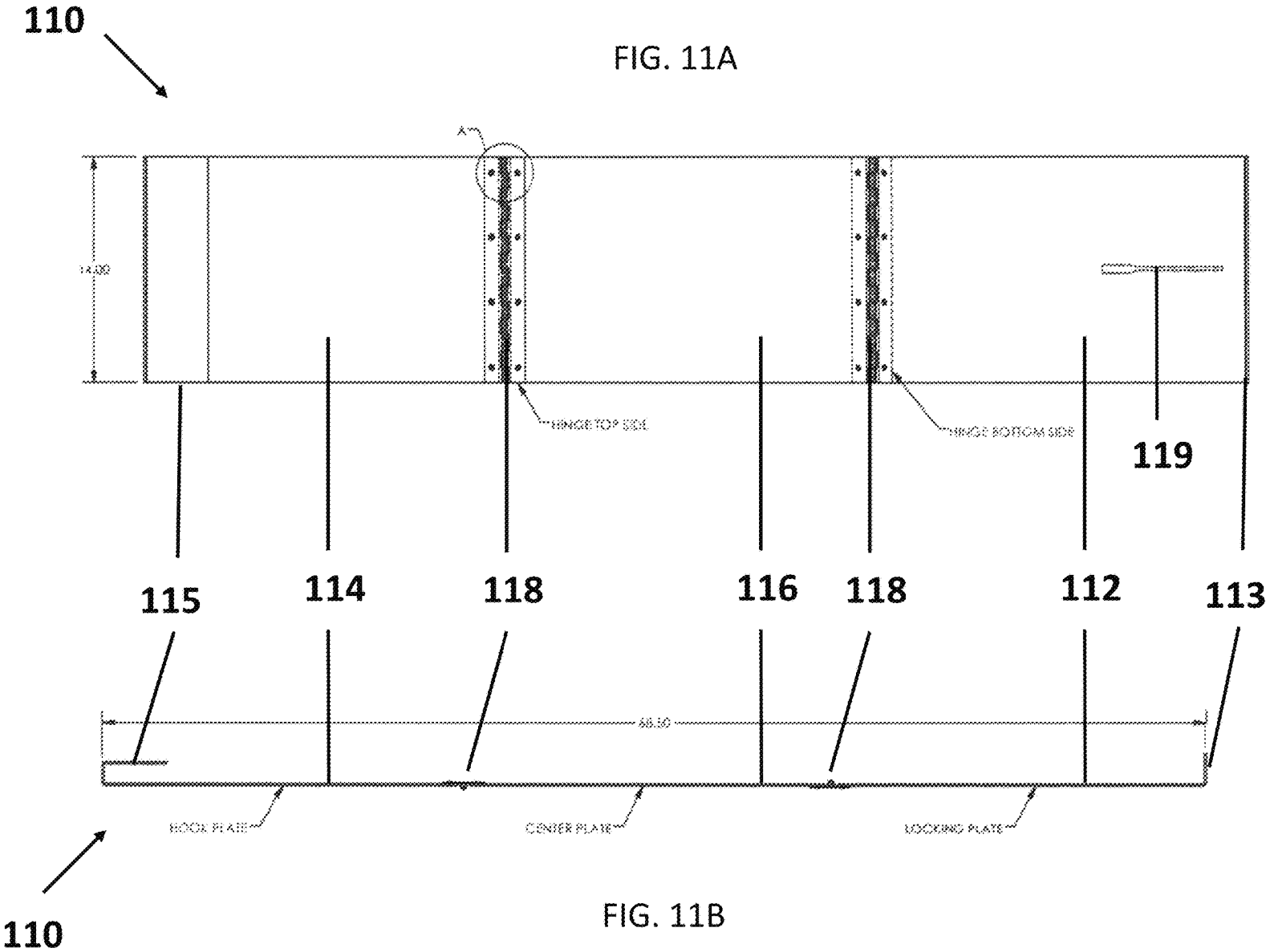
FIGS. 11A-E are drawings of a device according to an embodiment of the invention, including a top view (FIG. 11A), a side view (FIG. 11B), a folded configuration (FIG. 11C), a detail view of a panel with an installed adjustable member (FIG. 11D), and a hinge detail view (FIG. 11E).
Figure 11D:
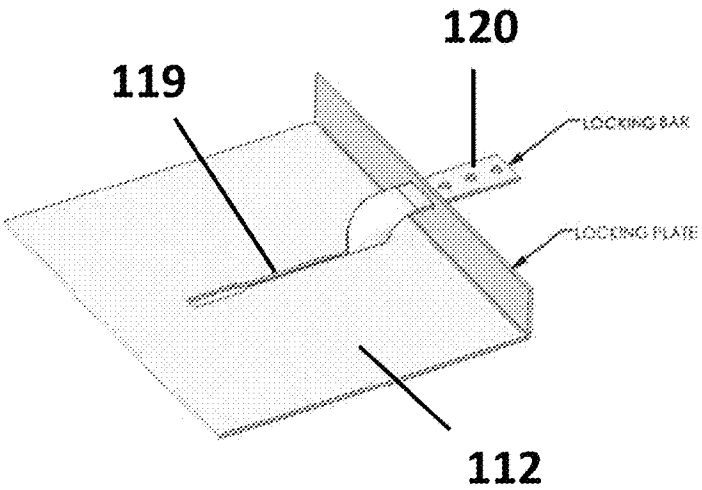
Figure 11C:
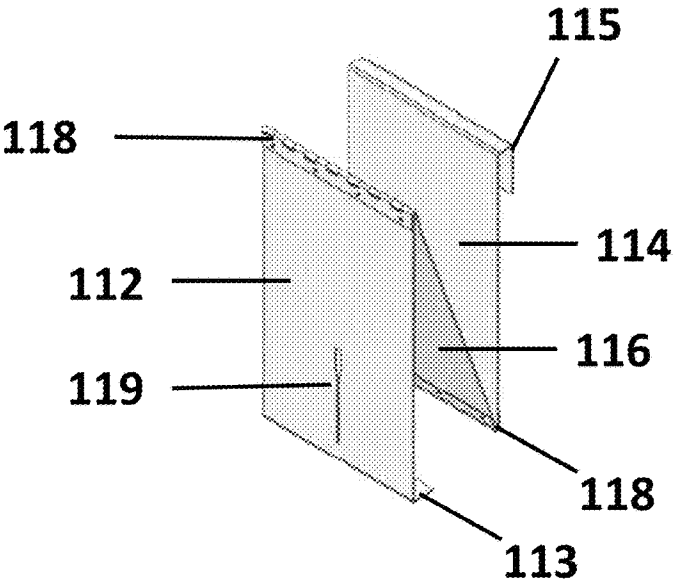
Figure 11E:
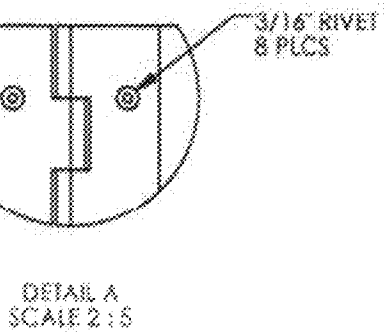

FIGS. 11A-B show a top view (FIG. 11A) and a side view (FIG. 11B) of a device 110 according to an embodiment of the invention. The device comprises a first panel 112, a second panel 114, and third panel 116. The first panel 112 comprises a first lip 113. The second panel 114 comprises a second lip 115. The panels are connected by hinges 118. In this embodiment, the hinges 118 are connected to the panels on opposite sides, such that the panels will rotate in opposite directions. The first panel 112 additionally comprises a vertical slit 119. FIG. 11C shows the device 110 in a folded configuration. FIG. 11D shows the first panel 112 with the adjustable member 120 installed according to an embodiment of the invention. FIG. 11E shows a detail view of hinge 118.

The present disclosure has described particular implementations having various features. In light of the disclosure provided above, it will be apparent to those skilled in the art that various modifications and variations can be made without departing from the scope or spirit of the disclosure. One skilled in the art will recognize that the disclosed features may be used singularly, in any combination, or omitted based on the requirements and specifications of a given application or design. When an implementation refers to "comprising" certain features, it is to be understood that the implementations can alternatively "consist of" or "consist essentially of" any one or more of the features. Other implementations will be apparent to those skilled in the art from consideration of the specification and practice of the disclosure.

It is noted in particular that where a range of values is provided in this specification, each value between the upper and lower limits of that range is also specifically disclosed. The upper and lower limits of these smaller ranges may independently be included or excluded in the range as well. The singular forms "a," "an," and "the" include plural referents unless the context clearly dictates otherwise. It is intended that the specification and examples be considered as exemplary in nature and that variations that do not depart from the essence of the disclosure fall within the scope of the disclosure. Further, all of the references cited in this disclosure including patents, published applications, and non-patent literature are each individually incorporated by reference herein in their entireties and as such are intended to provide an efficient way of supplementing the enabling disclosure as well as provide background detailing the level of ordinary skill in the art.

As used herein, the term "about" refers to plus or minus 5 units (e.g., percentage) of the stated value.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

As used herein, the term "substantial" and "substantially" refers to what is easily recognizable to one of ordinary skill in the art.

It is to be understood that the phraseology and terminology employed herein is not to be construed as limiting and are for descriptive purpose only.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

The invention claimed is:

1. A device for preventing unauthorized access to a ladder having a plurality of ladder rungs, comprising:

a first panel, comprising a first lip capable of engaging a first rung of the plurality of ladder rungs;

a second panel, comprising a second lip capable of engaging a second rung of the plurality of ladder rungs;

the first panel including a vertical slit;

one or more attachment mechanism for connecting the first panel to the second panel or for connecting at least one of the first panel and the second panel to one or more additional panel; and an adjustable member, comprising:

a first end configured to attach to the first panel via the vertical slit; and a second end comprising one or more hole(s);

wherein the adjustable member is slidably attached to the first panel, wherein the first lip comprises a horizontal slit, and wherein the second end of the adjustable member is sized such that it is capable of passing through the horizontal slit when the adjustable member is slid along the vertical slit.

2. The device of claim 1, wherein the first lip is disposed along a top edge of the first panel.

3. The device of claim 1, wherein the second lip is disposed along a bottom edge of the second panel.

4. The device of claim 1, wherein the one or more attachment mechanism is a hinge, and the hinge is disposed along a bottom edge of the first panel.

5. The device of claim 1, wherein the one or more attachment mechanism is a hinge and where the hinge connects the first panel to the second panel.

6. The device of claim 1, wherein the adjustable member is rotatably attached to the first panel.

7. The device of claim 1, wherein the first end of the adjustable member is disposed on one face of the first panel, the second end of the adjustable member is disposed on an opposite face of the first panel, and the adjustable member rests in the vertical slit.

8. The device of claim 1, wherein the first and second ends of the adjustable member are disposed on opposite sides of the vertical slit.

9. The device of claim 1, wherein the adjustable member is shaped and sized such that it is permanently attached to the first panel via the vertical slit.

10. The device of claim 1, wherein the second end of the adjustable member is configured to pass through the horizontal slit.

11. The device of claim 1, wherein the one or more additional panel is disposed between the first panel and the second panel.

12. The device of claim 1, wherein the device comprises a first hinge and a second hinge.

13. The device of claim 12, wherein the first hinge connects the first panel to an additional panel of the one or more additional panel and the second hinge connects the additional panel of the one or more additional panel to the second panel.

14. The device of claim 12, wherein the first hinge enables rotation of the first panel relative to an additional panel of the one or more additional panel and the second hinge enables rotation of the second panel relative to the additional panel of the one or more additional panel.

15. The device of claim 12, wherein the first hinge enables rotation of the first panel in a first direction relative to an additional panel of the one or more additional panel and the second hinge enables rotation of the second panel in a second direction relative to the additional panel of the one or more additional panel.

16. The device of claim 12, wherein the first hinge is disposed between the first panel and the one or more additional panel and the second hinge is disposed between the one or more additional panel and the second panel.

17. The device of claim 1, wherein the one or more hole(s) is disposed along the second end of the adjustable member.

18. The device of claim 1, wherein the first lip is configured to rest on the first rung of the ladder.

19. The device of claim 1, wherein the second lip is configured to hook around the second rung of the ladder.

20. The device of claim 1, wherein the adjustable member, the first panel, and the first lip are configured to enclose the first rung of the ladder.

21. The device of claim 6, wherein the adjustable member is configured to slide in a first direction to allow the first ladder rung to pass between the adjustable member and the first lip and to slide in a second direction to pass through the horizontal slit.

22. The device of claim 6, wherein the adjustable member is configured to slide in a first direction to provide a gap between the adjustable member and the first lip and to slide in a second direction to pass through the horizontal slit.

23. The device of claim 6, wherein the one or more hole(s) is disposed on the adjustable member such that the one or more hole(s) passes through the horizontal slit.

24. The device of claim 1, wherein the one or more attachment mechanism comprises a male member mated to a female member.

* * * * *